US007537360B2

(12) United States Patent
Allegri

(10) Patent No.: US 7,537,360 B2
(45) Date of Patent: May 26, 2009

(54) COLOR CHANGER PARTICULARLY FOR SPOTLIGHTS AND THE LIKE

(75) Inventor: Fabio Allegri, Castel Goffredo (IT)

(73) Assignee: Coemar S.p.A., Castel Goffredo (IT)

( * ) Notice: Subject to any disclaimer, the term of this patent is extended or adjusted under 35 U.S.C. 154(b) by 15 days.

(21) Appl. No.: 11/642,518

(22) Filed: Dec. 21, 2006

(65) Prior Publication Data

US 2007/0211468 A1 Sep. 13, 2007

(30) Foreign Application Priority Data

Mar. 10, 2006 (IT) ..... MI2006A0428

(51) Int. Cl.
*F21V 17/02* (2006.01)

(52) U.S. Cl. ..... 362/319; 362/2; 362/583; 362/35; 362/232; 362/233; 362/269; 362/250; 362/240; 362/239; 362/238; 362/268; 362/271; 362/272; 362/277; 362/284; 362/282; 362/287; 362/286; 362/285; 362/324; 362/449

(58) Field of Classification Search ..... None
See application file for complete search history.

(56) References Cited

U.S. PATENT DOCUMENTS 4,037,097 A * 7/1977 Stillman et al. ..... 362/324
4,392,187 A 7/1983 Bornhorst
4,602,321 A 7/1986 Bornhorst
4,974,136 A 11/1990 Noori-Shad et al.
5,073,847 A * 12/1991 Bornhorst ..... 362/293
5,126,886 A * 6/1992 Richardson et al. ..... 359/888
5,186,536 A 2/1993 Bornhorst et al.
5,367,444 A * 11/1994 Bornhorst et al. ..... 362/264

FOREIGN PATENT DOCUMENTS

EP 0 415 164 A 3/1991
GB 279 658 A 11/1927
JP 04 065002 A 3/1992
WO WO 03/093725 A2 11/2003

* cited by examiner

*Primary Examiner*—Sandra L O'Shea
*Assistant Examiner*—Danielle Dunn
(74) *Attorney, Agent, or Firm*—Modiano & Associati; Albert Josif; Daniel J. O'Byrne

(57) ABSTRACT

A color changer, particularly for spotlights, comprising at least one dichroic filter which is adapted to be arranged in front of a light source, a motor for moving the at least one dichroic filter which is adapted to place the dichroic filter at least partially in front of the light source, the color changer further comprising an actuator which is adapted to tilt the dichroic filter with respect to the axis of emission of the light source.

7 Claims, 3 Drawing Sheets

COLOR CHANGER PARTICULARLY FOR SPOTLIGHTS AND THE LIKE

The present invention relates to a color changer particularly for spotlights and the like. More particularly, the invention relates to a color changer which can be used inside the body of a spotlight to obtain selected color effects of the light.

BACKGROUND OF THE INVENTION

As is known, spotlights are commercially available inside which color changing filters, for example three dichroic filters, one for each of the individual fundamental colors, cyan, magenta and yellow, are arranged.

Such dichroic filters act at right angles, cutting the beam of the light emitted by an appropriate light source, such as for example a discharge lamp or a halogen lamp, or a light source formed by LEDs.

In the background art, each of the three dichroic filters is actuated by a respective motor which moves proportionally the color mix filter. Each color is placed in a variable percentage within the light beam. The motor used is usually of the step type and gradually moves selectively the color filters at right angles to the axis of the light beam.

The shades that can be obtained in this way are therefore many, but there is a constraint determined by the predefined tint of each dichroic filter and by the very mechanism used to move the dichroic filters within the beam of light.

Therefore, with currently known types of devices it is impossible to control with high definition the countless shades of color that compose the intended color and change its spectrum when such color is fully or partially inserted within the light beam.

Substantially, known types of color changers are unable to provide an image with high detail and high color definition.

SUMMARY OF THE INVENTION

The aim of the present invention is to provide a color changer particularly for spotlights and the like which allows to control in detail the shades of the three fundamental colors and extend their spectrum.

Within this aim, an object of the present invention is to provide a color changer, particularly for spotlights and the like, which allows to vary the main transmission frequency of each individual color, i.e., cyan, magenta and yellow.

Another object of the present invention is to provide a color changer particularly for spotlights and the like which allows to control with higher definition the countless shades of color that compose the intended color and alter its spectrum when the color is fully or partially inserted within the light beam.

Another object of the present invention is to provide a color changer particularly for spotlights and the like in which the resulting final image has a higher detail and color definition than in known types of solutions.

Still another object of the present invention is to provide a color changer which is highly reliable, relatively simple to provide and at competitive costs.

This aim and these and other objects, which will become better apparent hereinafter, are achieved by a color changer, particularly for spotlights and the like, comprising at least one dichroic filter which is adapted to be arranged in front of a light source, means for moving said at least one dichroic filter which are adapted to place said dichroic filter at least partially or totally in front of said light source, characterized in that it comprises actuation means which are adapted to tilt said dichroic filter with respect to the axis of said light source.

BRIEF DESCRIPTION OF THE DRAWINGS

Further characteristics and advantages of the invention will become better apparent from the description of a preferred but not exclusive embodiment of the color changer according to the present invention, illustrated by way of non-limiting example in the accompanying drawings, wherein.

DESCRIPTION OF THE PREFERRED EMBODIMENTS

Figure 1:
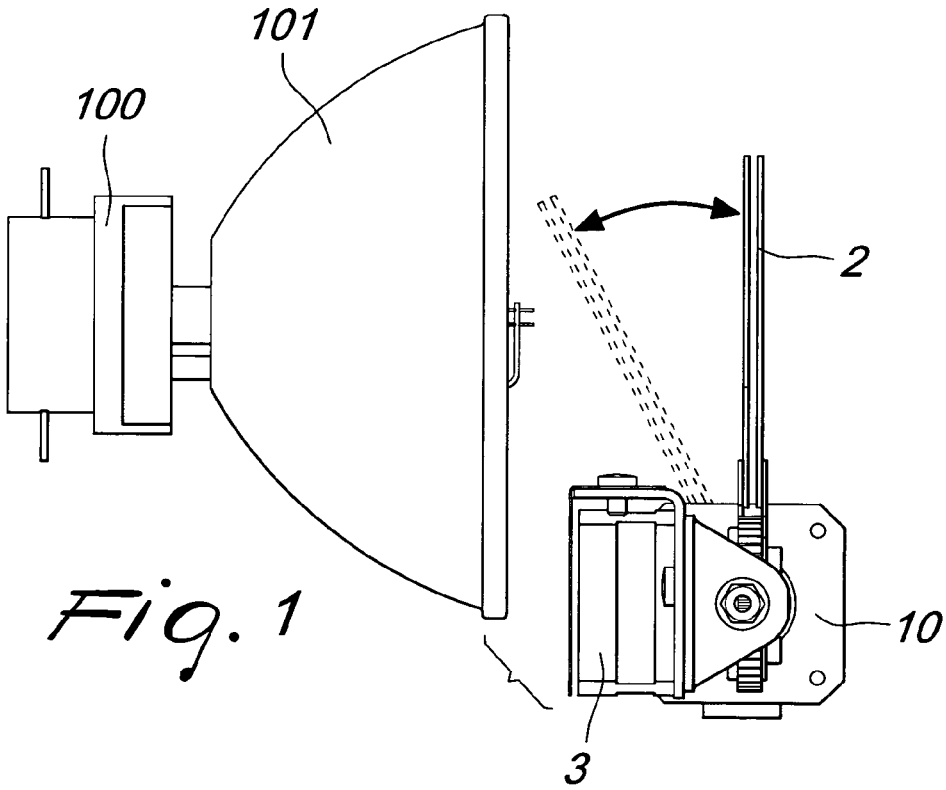
FIG. 1 is a side view of the color changer according to the invention, associated with a light source.
Figure 2:
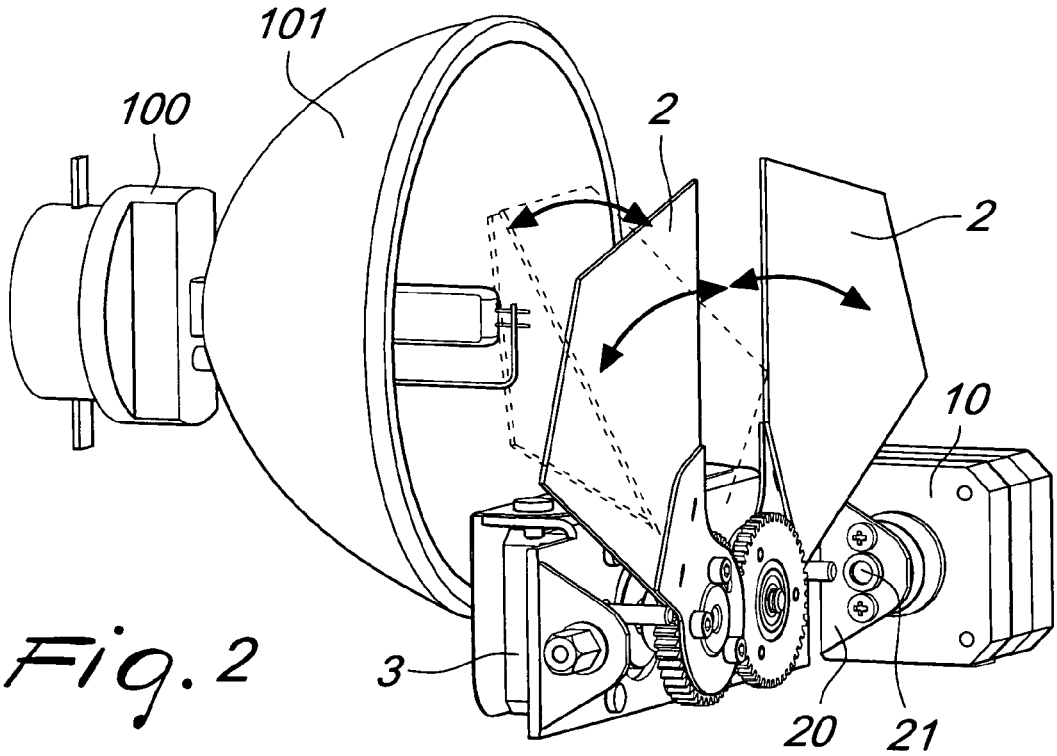
FIG. 2 is a perspective view of the color changer according to the present invention, showing only one dichroic filter.

With reference to the figures, the color changer according to the present invention, generally designated by the reference numeral 1, comprises a first dichroic filter 2 with corresponding movement means such as a motor 3, for example of the step type, which is adapted to make the filter cross the light beam emitted by a light source 100, which is further provided for example with a parabolic reflector 101, so as to place the dichroic filter at least partially in front of the light source.

The color changer therefore comprises, for each dichroic filter, a corresponding filter actuation motor. In the figures, the second dichroic filter is designated by the reference numeral 4, with a corresponding motor 5, and finally the third filter is designated by the reference numeral 6 with a corresponding motor 7.

The peculiarity of the invention resides in that it provides, for at least one dichroic filter 2, 4 and 6, and preferably for each of the dichroic filters 2, 4 and 6, actuation means which are adapted to tilt the dichroic filter with respect to the axis of the light beam. Substantially, the step motors 3, 5 and 7 are adapted to place the dichroic filters at least partially in front of the light beam emitted by the light source, thus producing a translational or rotary motion of the filters at right angles to the axis of emission of the light source. The actuation means cited above instead allow to move the dichroic filters 2, 4 and 6 by tilting them with respect to the axis of emission of the light source 100.

Conveniently, such actuation means include for example a step motor and are constituted by the step motor 10 for the dichroic filter 2, by the step motor 11 for the dichroic filter 4, and by the step motor 12 for the dichroic filter 6.

Therefore, each filter is provided with a step motor for the respective arrangement of the filter so as to intersect the axis of the light source and with a second step motor, related to the same filter, for tilting said filter with respect to the axis of the light source.

Figure 3:
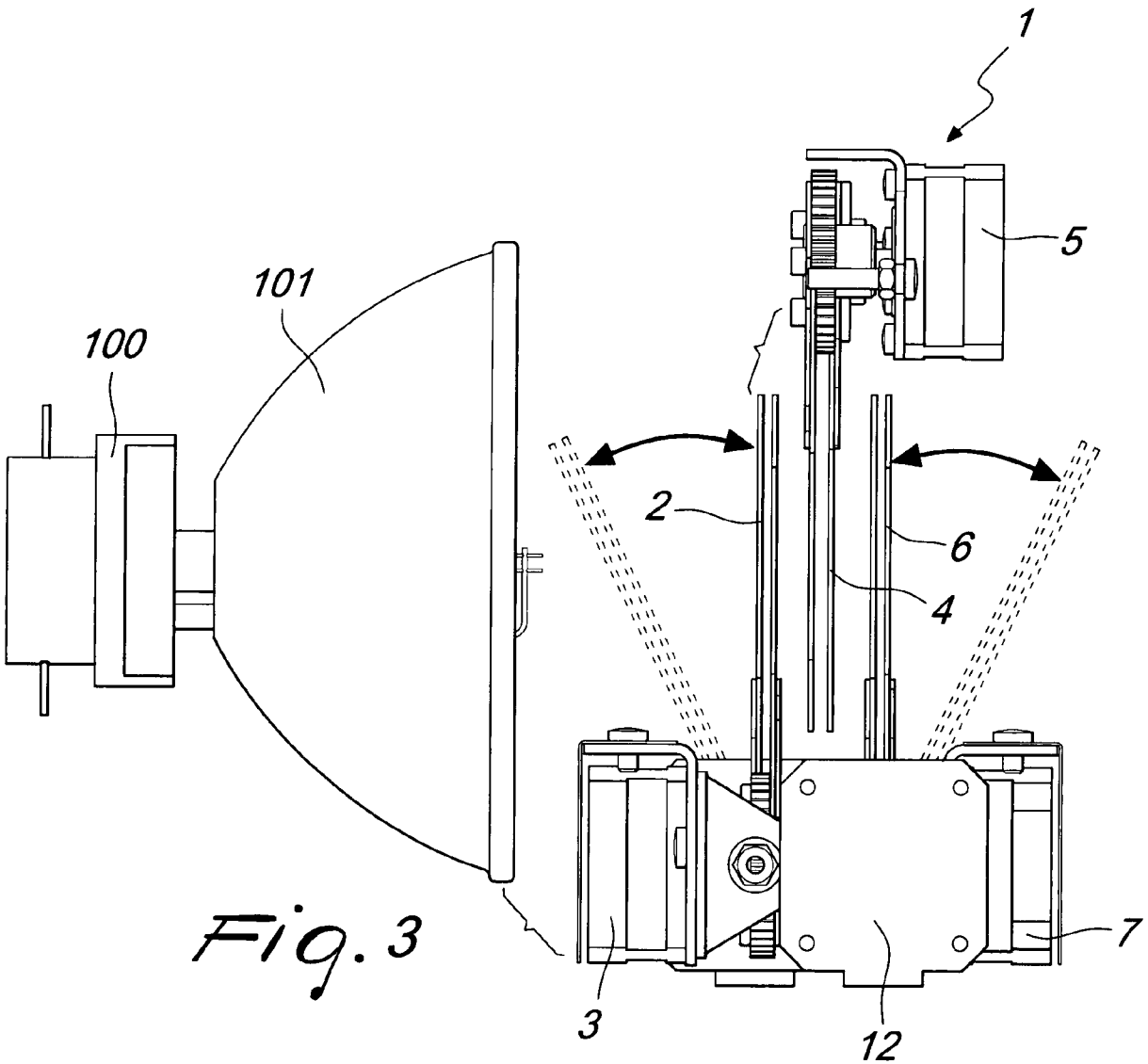
FIG. 3 is a side view of the color changer according to the present invention, showing all three dichroic filters.
Figure 4:
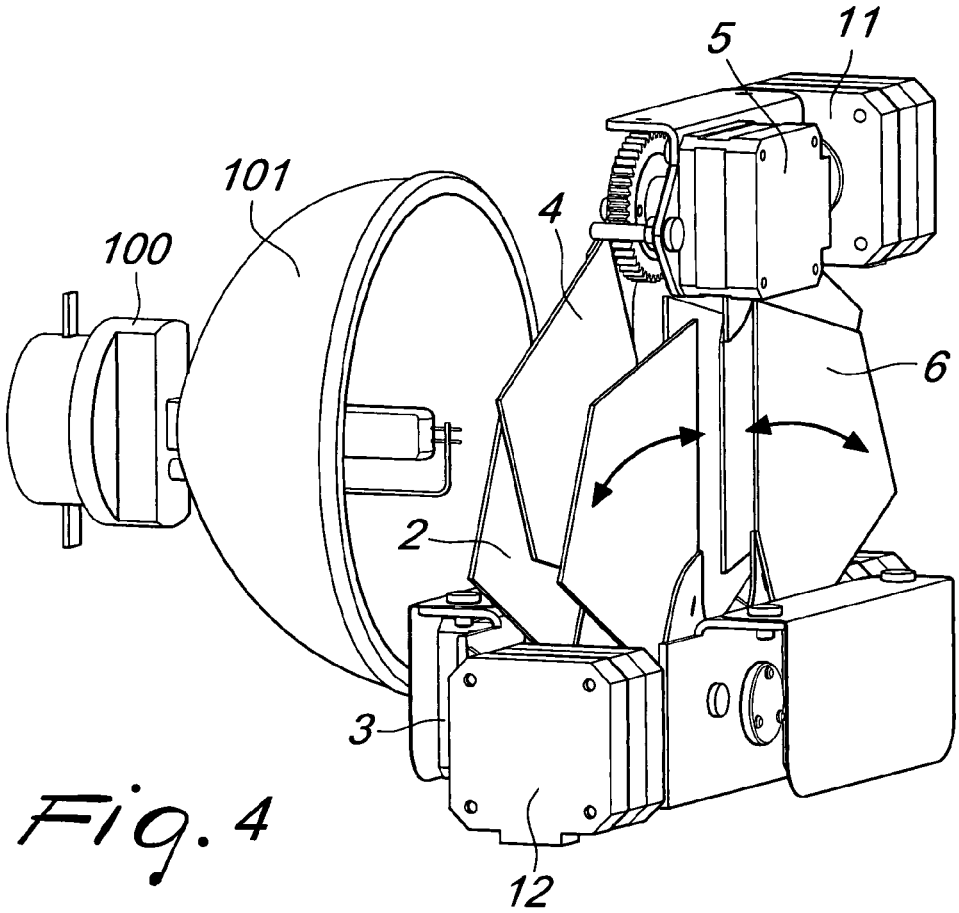
FIG. 4 is a perspective view of the color changer according to the present invention, showing the three dichroic filters.

FIG. 1 is a detail view of the tilting of the filter 2 and FIG. 3 illustrates in detail the tilting of the filter 2 and of the filter 6.

In detail, each motor related to a respective dichroic filter, to which the dichroic filter actuated by said motor is connected, is provided with a bracket 20, which is keyed to the motor shaft 21 of the motor intended to tilt the dichroic filter with respect to the axis of the light beam.

Substantially, therefore, the dichroic filter actuation motor for tilting said filter can be rigidly coupled to the motor that actuates the same dichroic filter to move it at right angles to the light beam. Therefore, the dichroic filter actuation motor designed to tilt the filter turns the dichroic filter with the corresponding motor designed to pass the dichroic filter at right angles through the light beam.

Since operation involves the three fundamental colors when they are inserted totally or proportionally, one can deduce that the color range that can be obtained by means of the color changer according to the invention extends considerably the possibility of choice within the color spectrum.

The choice of a given color is facilitated, allowing to achieve more detailed color shades and color differentiations.

The means for actuating the tilting of the filters can be not only step motors but also for example DC motors, which, for example but not necessarily, are appropriately coupled to the color changing block and move through a certain angle the axis of action at right angles to the light beam. Motor control can occur independently and is managed by means of an electronic circuit.

The colors that act at right angles in the light beam can move in a linear fashion or in a rotary manner in order to achieve the same result.

The physical composition of the individual color can be constituted by a single palette or can be divided into a plurality of portions or by an ordinary color wheel.

The arrangement of the color changing assembly along the optical axis is not binding for its proper operation.

In practice it has been found that the color changer according to the invention fully achieves the intended aim and objects, since it allows to achieve a variation of the main emission frequency of each individual color, with the effect of being able to control with higher definition the countless shades of color that compose the intended color and change its spectrum when it is fully or partially inserted.

The angle of incidence of the light on the dichroic filters produces considerable frequencies within the same shade.

The filters can be tilted along any spatial plane.

The color changer according to the invention can be used with a light source such as a halogen lamp or a discharge lamp of different power arranged on the horizontal or vertical axis with respect to the color changing assembly. Moreover, the color changer can also be applied to LED-emission light sources.

Figure 5:
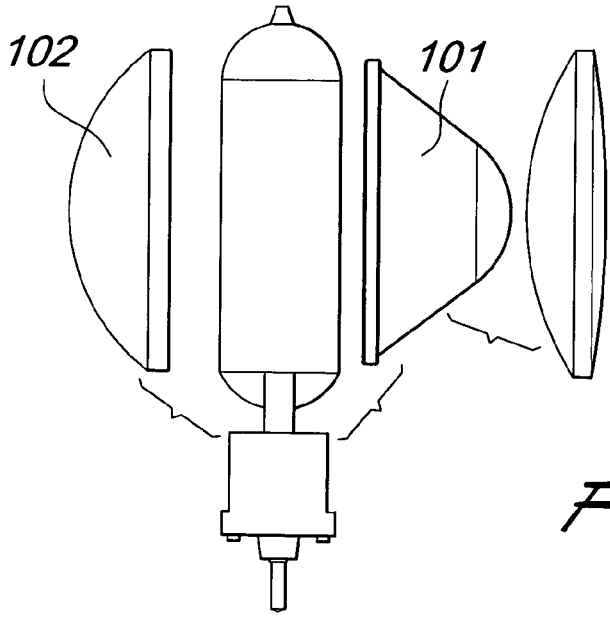
FIG. 5 is a schematic view of a possible form of application of the color changer according to the present invention.

FIG. 5 is a view of a solution which is an alternative to the use of a light conveyance device (parabolic reflector) 101. This figure shows that the same result can be obtained by using an optical condenser 102.

It is further possible to use a set of lenses to control the breadth of the projection in applications of the wash and spot type.

The device thus conceived is susceptible of numerous modifications and variations, all of which are within the scope of the appended claims; all the details may further be replaced with other technically equivalent elements.

In practice, the materials used, as well as the contingent shapes and dimensions, may be any according to requirements and to the state of the art.

The disclosures in Italian Patent Application No. MI2006A000428 from which this application claims priority are incorporated herein by reference.

What is claimed is:

1. A color changer, particularly for spotlights, comprising at least one dichroic filter which is adapted to be arranged in front of a light source, movement means for moving said at least one dichroic filter in front of said light source in a movement direction that is perpendicular to an axis of emission of said light source, and actuation means for tilting said dichroic filter with a tilting actuation movement about a tilting axis that is perpendicular to said axis of emission of said light source, said movement means and said actuation means being mutually separate and independent such that said dichroic filter is movable in said movement direction separately and independently with respect to said tilting actuation movement, said movement means comprising a movement motor and said actuation means comprising an actuation motor, said dichroic filter being connected to a bracket that supports said movement motor, and said bracket having an output shaft connected thereto of said actuation motor.

2. The color changer according to claim 1, comprising three dichroic filters for the three fundamental colors, respective said movement means for moving each one of said three dichroic filters, and respective said actuation means for each one of said three dichroic filters.

3. The color changer according to claim 1, wherein said actuation motor is a step motor.

4. The color changer according to claim 1, wherein said movement motor is a step motor.

5. The color changer according to claim 1, wherein said actuation means for tilting said at least one dichroic filter are adapted to tilt said dichroic filter in any spatial plane that comprises said tilting axis.

6. A spotlight, comprising:

a light source having an axis of light emission; and a color changer comprising at least one dichroic filter which is arranged in front of said light source, movement means for moving said at least one dichroic filter in front of said light source in a movement direction that is perpendicular to said axis of emission of said light source, and actuation means for tilting said dichroic filter with a tilting actuation movement about a tilting axis that is perpendicular to said axis of emission of said light source, said movement means and said actuation means being mutually separate and independent such that said dichroic filter is movable in said movement direction separately and independently with respect to said tilting actuation movement, said movement means comprising a movement motor and said actuation means comprising an actuation motor, said dichroic filter being connected to a bracket that supports said movement motor, and said bracket having an output shaft connected thereto of said actuation motor.

7. A color changer for spotlights, comprising:

a first dichroic filter movable in a first plane by means of a first step motor;

a second dichroic filter movable in a second plane by means of a second step motor;

a third dichroic filter movable in a third plane by means of a third step motor;

a forth step motor connected to said first dichroic filter to tilt said first dichroic filter about a first tilting axis that is parallel to said first plane;

a fifth step motor connected to said second dichroic filter to tilt said second dichroic filter about a second tilting axis that is parallel to said second plane;

a sixth step motor connected to said third dichroic filter to tilt said third dichroic filter about a third tilting axis that is parallel to said third plane;

all of said step motors being adapted to operate mutually separately and independently;

each said dichroic filter being connected to a respective bracket that supports a respective said step motor for moving said dichroic filter in its respective plane, and each said bracket having an output shaft connected thereto of a respective step motor for tilting said dichroic filter.

* * * * *